US008590744B2

(12) United States Patent
Orr

(10) Patent No.: US 8,590,744 B2
(45) Date of Patent: Nov. 26, 2013

(54) LIQUID STORAGE DISPENSING APPARATUS

(76) Inventor: Timothy E. Orr, Redding, CA (US)

( * ) Notice: Subject to any disclaimer, the term of this patent is extended or adjusted under 35 U.S.C. 154(b) by 0 days.

(21) Appl. No.: 13/353,651

(22) Filed: Jan. 19, 2012

(65) Prior Publication Data

US 2013/0284760 A1 Oct. 31, 2013

(51) Int. Cl.
*B65D 35/28* (2006.01)

(52) U.S. Cl.
USPC ..... 222/95; 222/209

(58) Field of Classification Search
USPC ..... 222/95, 94, 100, 105, 106, 399, 394, 222/209, 213–215
See application file for complete search history.

(56) References Cited

U.S. PATENT DOCUMENTS

| | | | | |
|---|---|---|---|---|
| 3,404,813 | A | 10/1968 | Waxman | |
| 3,549,050 | A | 12/1970 | Bruce et al. | |
| 3,883,046 | A | 5/1975 | Thompson et al. | |
| 4,013,195 | A | 3/1977 | Ferris | |
| 4,138,036 | A | 2/1979 | Bond | |
| 5,139,168 | A | 8/1992 | Gueret | |
| 5,156,300 | A | 10/1992 | Spahni et al. | |
| 5,505,339 | A * | 4/1996 | Cowger et al. | 222/105 |
| 6,096,007 | A * | 8/2000 | Haan et al. | 604/147 |
| 7,810,679 | B2 * | 10/2010 | Wauters et al. | 222/399 |
| 2008/0105711 | A1 * | 5/2008 | Kirimli et al. | 222/209 |
| 2009/0057347 | A1 | 3/2009 | Leys et al. | |
| 2009/0212071 | A1 * | 8/2009 | Tom et al. | 222/95 |
| 2010/0018994 | A1 * | 1/2010 | Antheil et al. | 222/105 |

* cited by examiner

*Primary Examiner* — Lien Ngo
(74) *Attorney, Agent, or Firm* — Theodore J. Bielen, Jr.

(57) ABSTRACT

A liquid storage and delivery apparatus utilizing a canister or container which holds a flexible diaphragm supported by a frame. The frame biases the flexible diaphragm against the inner wall of the container and allows expansion and contraction of the diaphragm in certain direction. A seal creates a substantially air tight space within the canister to allow directed pressurized gas to motivate the movement of the diaphragm within the canister. A lid or fitting supports a collapsible bag carrying a liquid within a second space within the canister such that movement of the flexible diaphragm against the collapsible bag forces or squeezes liquid from the same for use.

16 Claims, 4 Drawing Sheets

LIQUID STORAGE DISPENSING APPARATUS

BACKGROUND OF THE INVENTION

Potable liquids such, as spirits and the like, are normally distributed and transported in barrels for eventual use in commercial establishments. Although such storage and delivery methods have been successful in providing potable liquids, the use of barrels has certain disadvantages.

For example, barrels, which are normally constructed of rigid material such as metal and wood, take up counter space. Also, once a barrel is emptied it must be returned to a facility, cleaned, and sanitized for reused. Needless to say, such recycling of barrels is labor intensive and relatively expensive to carry out.

A recent development in the storage and distribution of potable liquids entails the use of flexible plastic bags. Such usage is especially prevalent with spirits such as wines. Although such containers are disposable, the cost of manufacturing and employing such plastic bags is far less than the expensive associated with reusable barrels.

A problem does remain in that dispensing the liquid from the plastic bags to the eventual user has yet to be properly addressed.

In the past, many systems have been proposed to transport and dispense liquids. For example, U.S. Pat. No. 3,549,050 describes a pressurized dispensed in which a flexible elastic bag separates the dispenser's product from its propellant. In this manner, prevention of blockage of the valves orifice is accomplished.

U.S. Pat. Nos. 4,138,036, 5,139,168, and 5,156,300 teach flexible or semi-rigid containers in which internal supports are employed to prevent uneven radial collapse of the plastic container when liquid is removed from the same.

U.S. Pat. Nos. 3,404,813, 3,883,046, and 4,013,195 show rigid tanks containing an internal bladder used to expel liquid from the rigid tank. The internal bladders include reinforcements to maintain the elongation or other controlled shapes.

United States Patent Application Publication 2009/0057347 illustrates a method and apparatus for dispensing fluids in which a bag is found within a bag and placed within a bottle assembly. The dispensing containers position adjacent or sandwich between one or more flexible pressurization containers to squeeze liquid from the same during the dispensing process.

A liquid storage and dispensing mechanism that is compatible with a flexible container used to transport potable liquids would be an notable advance in the field of food and beverages.

SUMMARY OF THE INVENTION

In accordance with the present invention a novel and useful liquid storage and dispensing apparatus is herein provided.

The apparatus of the present invention utilizes a container having a bottom and side portion extending outwardly from the bottom to form a chamber. The chamber has an opening for access to the same. Chambers used in combination with a source of pressured gas, such as nitrogen and the like, as well as a collapsible bag that storages liquid to be dispensed by the apparatus of the present invention.

A flexible diaphragm is also employed in the present apparatus and is formed to provide a casing defining an inner cavity. The flexible diaphragm may be made of any suitable material such as rubber, polymeric films, any combinations thereof, and the like. A flexible diaphragm mounts within the chamber of the container such that the cavity possesses a perimeter. The flexible diaphragm is fitted into a frame which includes a flange member that contacts and supports the diaphragm. The frame positions at least the portion of the casing of the flexible diaphragm adjacent the bottom and side portion of the container. The frame may also be formed with one or more partitions that are generally rigid and lie adjacent the casing of the flexible diaphragm. Such partitions allow placement of the collapsible liquid containing bag within the cavity of the diaphragm prior to expulsion of liquid from the collapsible liquid containing bag.

A substantially airtight seal is formed in a space between the container and the flexible diaphragm. Such space lies outside of the cavity of the flexible diaphragm which expands and contracts, dependent on the introduction or removal of pressurized gas from the space. In this regard, an entry to the space allows such pressurized gas to flow from the source. When the gas is introduced into the space, such gas impinges on the flexible diaphragm to urge the flexible diaphragm against the collapsible bag which is placed in the cavity of the diaphragm. The squeezing of the diaphragm against the collapsible bag forces liquid from the collapsible bag through an exit of the collapsible bag and outside the apparatus of the present invention. The liquid is then dispensed as desired for use.

A lid may also be employed with the present invention that fits adjacent to the container side portion. The lid includes an aperture which communicates with the cavity of the flexible diaphragm. In addition, the lid may be formed with projection that extends into the cavity of the flexible diaphragm and provides a support for the collapsible bag extending into the cavity of the diaphragm. The support would, thus, permit expansion of the flexible diaphragm into the cavity of the collapsible bag, causing shrinking of the collapsible bag when squeezed by the pressured diaphragm. A guard may also be provided adjacent the support to prevent the collapsible bag from expanding upwardly and hindering flow of liquid to the exit of the collapsible bag. In this regard, the lid may also allow access of pressurized gas to the substantially airtight space formed between the container and the flexible diaphragm.

It may be apparent that a novel and useful liquid storage and delivery apparatus has been hereinabove described.

It is therefore an object of the present invention to provide a liquid storage and delivery apparatus which is capable of dispensing potable liquids stored in bags or pouches formed of polymeric or other flexible materials.

Another object of the present invention is to dispense liquids found in pouches or bags formed of flexible materials and, to a large degree, dispensing the entire content of the bag or pouch during such operation.

Another object of the present invention is to provide a liquid storage and delivery apparatus which eliminates the disadvantages of shipping and storing potable liquids in rigid barrels.

A further object of the present invention is to provide a liquid storage and delivery apparatus which permits the use of flexible containers to ship and store potable liquids and further allow the interchanging of such flexible containers with the apparatus of the present invention.

Another object of the present invention is to provide a liquid storage and delivery apparatus which greatly reduces the cost of shipping potable liquids from a source to the place of use.

A further object of the present invention is to provide a liquid storage and delivery apparatus which saves counter space in an establishment where such potable liquids are dispensed.

Yet another object of the present invention is to provide a liquid storage and delivery apparatus which employs low pressure gas systems that are already found in restaurants, bars, and the like where such potable liquids are dispensed.

The invention possesses other objects and advantages especially as concerns particular characteristics and features thereof which will become apparent as the specification continues.

The following drawings should be further employed to understand the invention sought for patenting in the present application.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be taken in conjunction with the prior described drawings.

Figure 1:
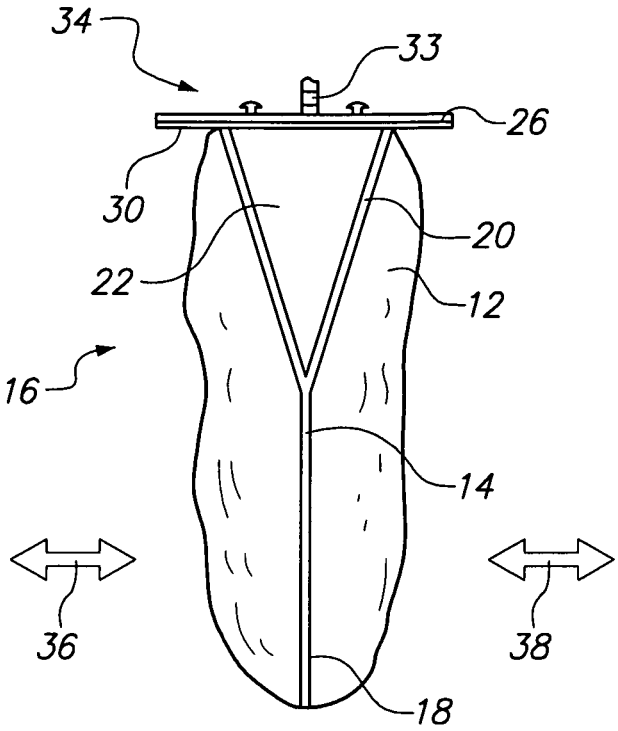
FIG. 1 is a side elevational view of the flexible diaphragm and frame for holding the same.
Figure 2:
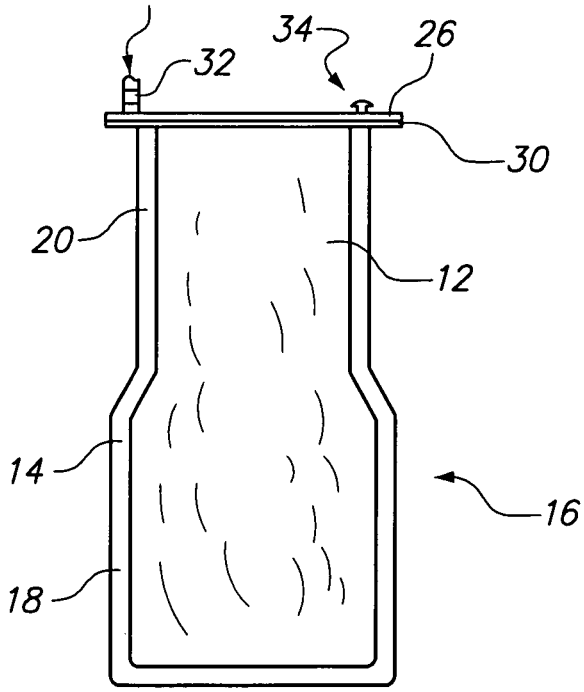
FIG. 2 is a front elevational view of the flexible diaphragm and the frame for holding the same.

An embodiment of the invention as a whole is depicted in the drawings by reference character 10, FIGS. 5-8. A necessary element of apparatus 10 is shown in FIGS. 1 and 2 takes the form of a flexible diaphragm 12 which may be constructed of rubberized material, plastic material, and the like. Diaphragm 12 is supported by a relatively rigid frame 14 to form an air impervious unit 16. The frame is formed with a flange or loop portion 18 which is firmly fixed to diaphragm 12 by the use of fasteners, glue, unitary construction or the like. Flange 18 includes an upper Y-shaped portion 20 which accommodates partitions 22 and 24, FIGS. 1 and 5. Partitions 22 and 24 create an entry space 76 for pressurized gas and allows the placement of a collapsible bag 62, which will be discussed hereinafter in further detail. A fitting 26 serves as a seal for container 28, FIG. 5, which will be further delineated as the specification continues. Fitting 26 includes a gasket member 30 and pressurized gas nipple or inlet 32. In addition, keyhole pins 34 extend outwardly from fitting 26. It should be realized that diaphragm 12 is free to move towards and away from frame 14 according to directional arrows 36 and 38, FIG. 1.

Figure 3:
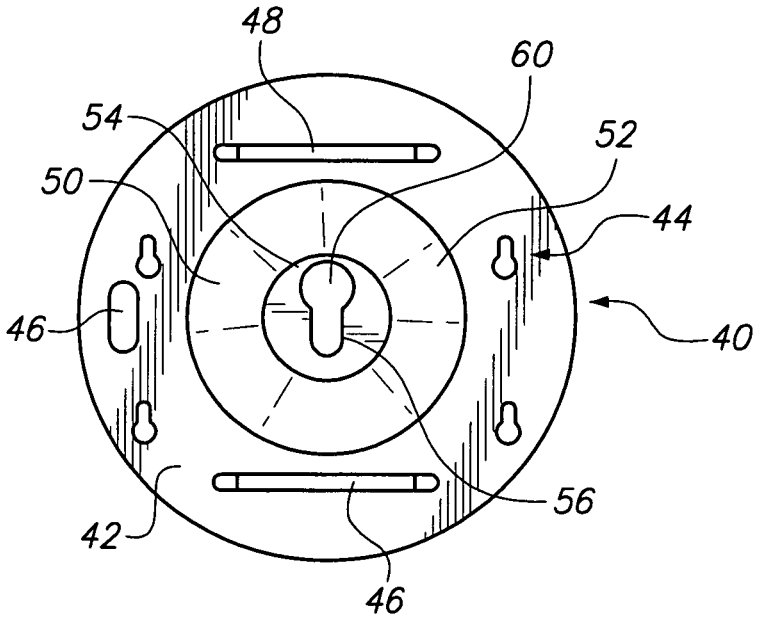
FIG. 3 is a top plan view of the lid portion of the apparatus of the present invention.
Figure 4:
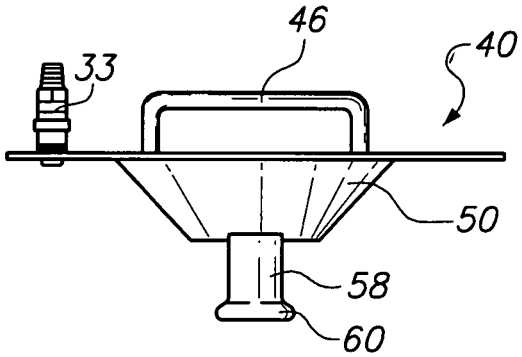
FIG. 4 is a side elevational view of the lid depicted in FIG. 3, with the addition of a pressurized gas nipple.

Turning now to FIGS. 3 and 4, it may be observed that a top or lid 40 is shown for use with container 28. Lid includes a ring-shaped upper portion 42 having a plurality of keyholes 44 which are intended to engage keyhole pins 34. In addition, an opening 46 is included to accommodate gas nipple 32 which extend from fitting 26 shown in FIGS. 1 and 2. Gas coupler 33 is depicted in FIG. 4. Handles 46 and 48 also extend from ring-shaped upper portion 42 to allow handling of lid 40 by the user. A truncated conicle projection 50 extends through aperture 52 of lid 40. Projection 50 includes a plate 54 having a keyhole-shaped passageway 56. Tab 58 extends downwardly from projection 50 and supports a bladder pressure guard 60 which has a corrugated surface.

Figure 5:
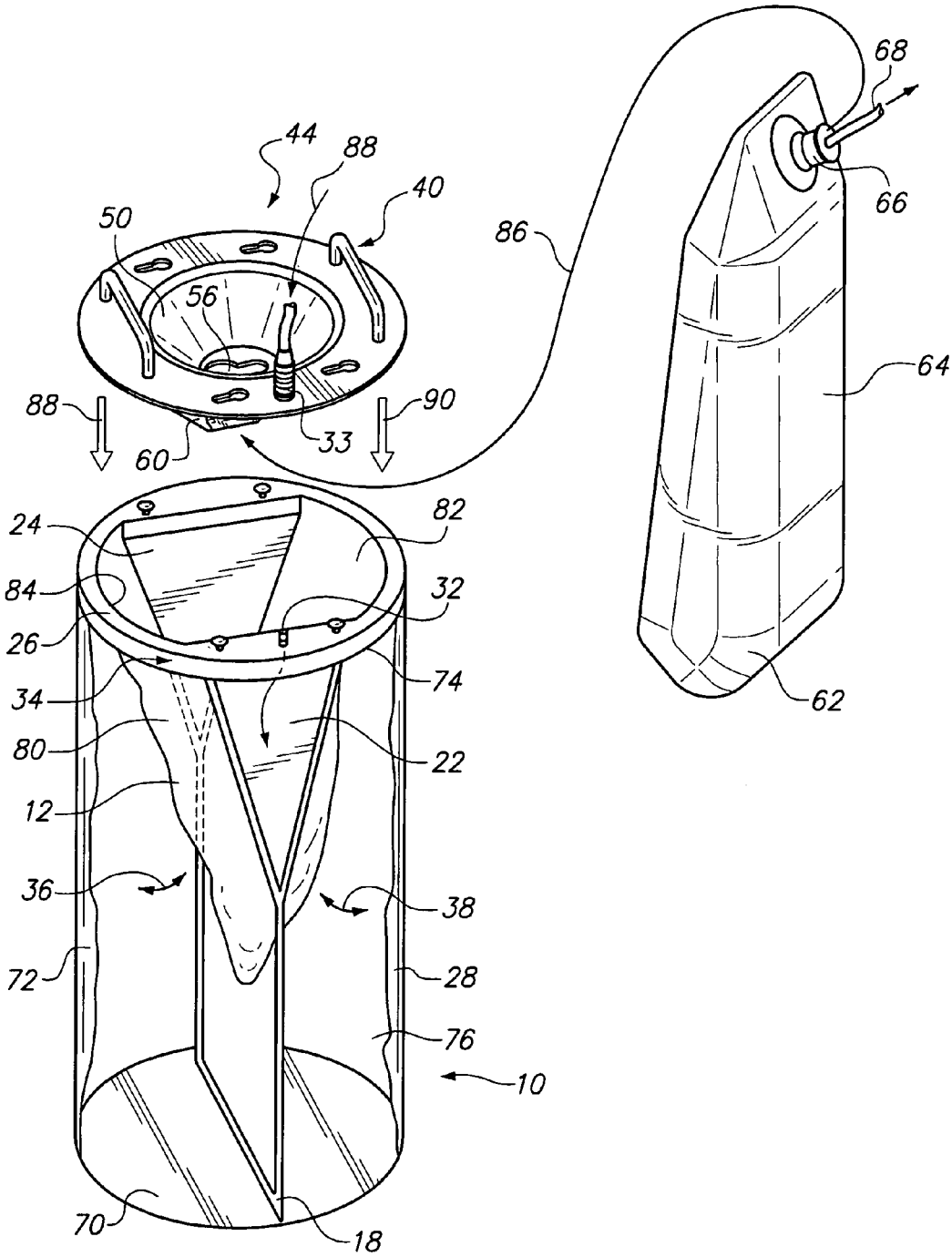
FIG. 5 is a top right side perspective view of the apparatus of the present invention in an exploded configuration with the liquid containing plastic bag depicted apart from the apparatus, with the container interior revealed.

Looking now at FIG. 5, it may be observed that container 28, air impervious unit 16, and lid 40 are shown along with collapsible bag 62 which contain liquids to be dispensed. In this regard, bag 62 includes a body portion 64 as well as a gland 66 connected to a dispensing tube 68. Gland 66 is intended to fit into keyhole-shaped passageway 66 of lid 40 and lie against bladder pressure guard 60. In this manner, the body portion 64 of collapsible bag 62 does not ride or balloon upwardly against lid 40 when bag 62 is emptied in apparatus 10. Such a movement of bag 62 would stop the egress of liquid from bag 62 via gland 66 and dispensing tube 68, should it occur. It may be apparent that container 28 includes a bottom portion 70 as well as side portion 72 which extends outwardly from bottom portion 70. The result is a generally cylindrical shaped container 28 having a top 74, side upon which fitting 26 sits. Casing 80 and unitary partitions 22 and 24 form a cavity 82 into which collapsible bag 62 is inserted. Fitting 26, thus, seals a space 76 which lies apart from the cavity 82. It should be noted that collapsible bag 62 extends toward the bottoms 70 of container 28 within cavity 82 of flexible diaphragm 12, which is only shown as being partially expanded in FIG. 5. It should also be realized, that fitting 26 seals perimeter 84 of cavity 82 in the formation of space 76. It should also be seen that cavity 82 is not intended to be pressurized, as is the case with space 76. Directional arrow 86 depicts the placement of bag 62 within cavity 82 of flexible diaphragm 12. Directional arrows 88 and 90 show the mating of lid 40 with fitting or seal 26 by the use of keyhole pins 34, best shown in FIG. 1, with keyholes 44 of lid 40. Again, such mating of lid 40 with fitting 26 also causes the engagement of nipple 32 with coupler 33 to allow pressurized gas to be directed from a source (not shown), of conventional configuration. Such source may include pressurized gas of nitrogen, carbon dioxide, and the like. Directional arrow 88 indicates the movement of pressurized gas through coupler 33, nipple 32, and into space 76 along the side of partition 22. Of course, liquid containing collapsible bag 62 is mated with lid 40 via gland 66 and keyhole-shaped passageway 56 prior to placement of lid 40 atop fitting 26, in this regard.

Figure 6:
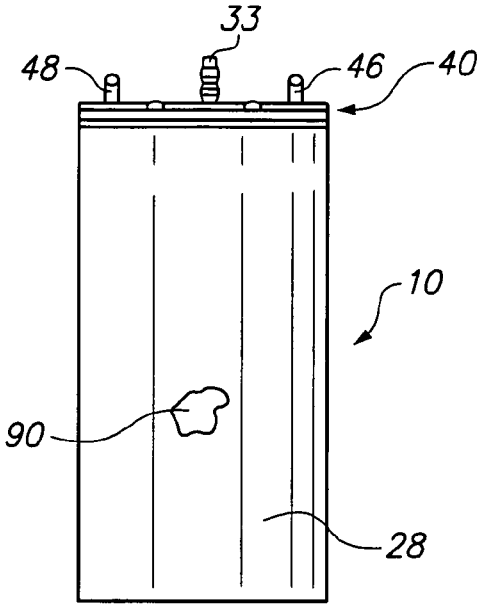
FIG. 6 is a front elevational view of the apparatus of the present invention in its assembled condition holding the liquid containing plastic bag therewithin.
Figure 7:
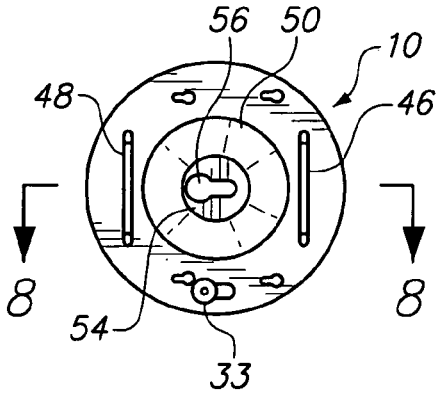
FIG. 7 is a top plan view of the apparatus of the present invention depicted in FIG. 6.
Figure 8:
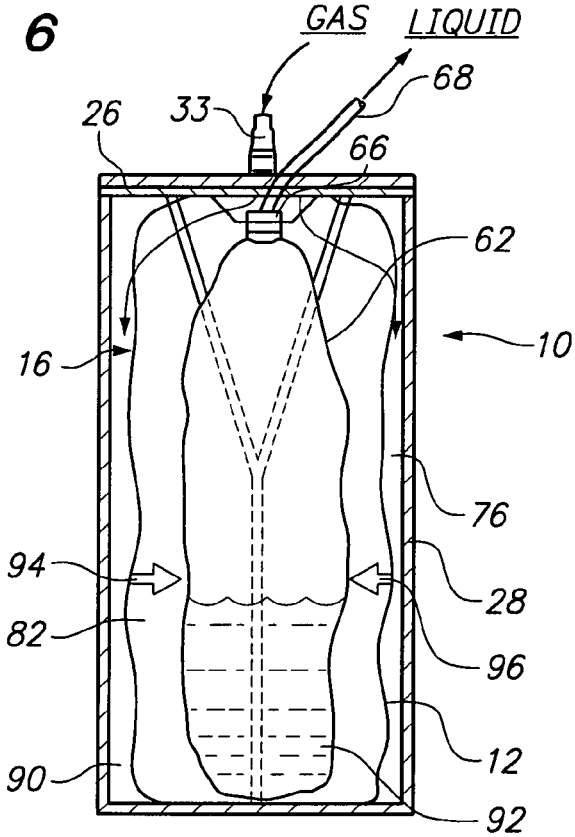
FIG. 8 is a sectional view taken along line 8-8 of FIG. 7 showing the wall of the diaphragm and the body of the liquid containing plastic bag as lines.

With reference to FIGS. 6-8, apparatus 10 is depicted in its assembled condition with liquid containing bag 62 found within cavity 82 of flexible diaphragm 12. It should be apparent that air impervious unit 16 and liquid containing collapsible bag 62 fit into a chamber 90 of container 28.

In operation, once apparatus 10 has been assembled as depicted in FIGS. 6-8, gas is introduced into coupler 33 and corresponding nipple 32 for entry into space 76 within chamber 90 of container 28. At this point, liquid containing collapsible bag 62 has been supported by plate 54 via keyhole-shaped passageway 56 and against bladder pressure guard 60. Such introduction of pressurized gas to space 76 causing the movement of flexible diaphragm 12 toward and against liquid containing collapsible bag 62. A quantity of liquid 92 is depicted in FIG. 8, within liquid containing collapsible bag 62, in this regard. Movement of flexible diaphragm 12, directional arrows 94 and 96 will collapse or squeeze bag 62 forcing liquid through bag exit tube 68. The shutting off of gas pressure into space 76 will stop the flow of liquid 68 from exit to 86. Thus, the flow liquid may be easily controlled by regulating the input of gas into space 76 in apparatus 10. Absent the application of gas to space 76, liquid may be stored within bag 62 until needed.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A liquid storage and delivery apparatus in combination with a source of pressurized gas;

comprising:

a. a container, said container comprising a bottom, a side portion extending outwardly from said bottom forming a chamber, and an opening to said chamber;

b. a flexible diaphragm said flexible diaphragm including a casing defining a cavity, said flexible diaphragm mounting within said chamber of said container, said cavity possessing a perimeter;

c. a frame, said frame including a flange member, said flange member contacting said of said flexible diaphragm and positioning at least a portion of said casing of said flexible diaphragm adjacent the bottom and side portion of said container;

d. a collapsible bag, said bag being positioned within said cavity of said flexible diaphragm, said collapsible bag holding a liquid and including an exit for the liquid;

e. a substantially airtight seal for forming a space between said container and said flexible diaphragm outside said cavity of said flexible diaphragm; and f. an entry into said space between said container and said flexible diaphragm, said entry directing gas from the source of pressurized gas to said space between said container and said flexible diaphragm, the gas impinging on said flexible diaphragm for urging said flexible diaphragm against said collapsible bag and forcing liquid from said collapsible bag through said exit of said collapsible bag.

2. The apparatus of claim 1 in which further comprises a lid fitting adjacent said container side portion, said lid including an aperture communicating with said cavity of said flexible diaphragm.

3. The apparatus of claim 2 in which said lid comprises a projection extending into said cavity of said flexible diaphragm said projection including a support for said collapsible bag and permitting expansion of said collapsible bag into said cavity of said flexible diaphragm.

4. The apparatus of claim 3 in which said projection further including a guard, said guard contacting said collapsible bag and hindering occupation of the exit of the collapsible bag.

5. The apparatus of claim 1 in which said substantially airtight seal comprises a fitting, said fitting position along said perimeter of said cavity of said flexible diaphragm and lying over said space between said container and said flexible diaphragm.

6. The apparatus of claim 1 in which said frame further comprises a partition, said partition lying adjacent and being integral with said casing of said flexible diaphragm.

7. The apparatus of claim 6 in which further comprises a lid fitting adjacent said container side portion, said lid including an aperture communicating with said cavity of said flexible diaphragm.

8. The apparatus of claim 7 in which said lid comprises a projection extending into said cavity of said flexible diaphragm said projection including a support for said collapsible bag and permitting expansion of said collapsible bag into said cavity of said flexible diaphragm.

9. The apparatus of claim 8 in which said projection further including a guard, said guard contacting said collapsible bag and hindering occupation of said lid aperture by said collapsible bag.

10. The apparatus of claim 6 in which said substantially airtight seal comprises a fitting, said fitting position along said perimeter of said cavity of said flexible diaphragm and lying over said space between said containers and said flexible diaphragm.

11. A liquid storage and delivery apparatus utilized with a liquid filled collapsible bag having an exit for the liquid and a source of pressurized gas;

comprising:

a. a container, said container comprising a bottom, a side portion extending from said bottom forming a chamber, and an opening to said chamber;

b. a flexible diaphragm, said flexible diaphragm including a casing forming a cavity said flexible diaphragm mounting within said chamber of said container, said cavity possessing a perimeter, the collapsible bag being positioned within said cavity of said flexible diaphragm;

c. a frame, said frame including a flange member, said flange member contacting said casing of said flexible diaphragm adjacent the bottom and side portion of said container;

d. a substantially airtight seal for forming a space between said container and said flexible diaphragm outside said cavity of said flexible diaphragm; and e. an entry into said space between said container and said flexible diaphragm, said entry directing gas from the source of pressurized gas to said space between said container and said flexible diaphragm, the gas impinging on said flexible diaphragm for urging said flexible diaphragm against the collapsible bag and forcing liquid from the collapsible bag through said exit of the collapsible bag.

12. The apparatus of claim 11 in which further comprises a lid fitting adjacent said container side portion, said lid including an aperture communicating with said cavity of said flexible diaphragm.

13. The apparatus of claim 12 in which said lid comprises a projection extending into said cavity of said flexible diaphragm said projection including a support for the collapsible bag and permitting expansion of the collapsible bag into said cavity of said flexible diaphragm.

14. The apparatus of claim 13 in which said projection further including a guard, said guard contacting the collapsible bag and hindering occupation of said lid aperture by the collapsible bag.

15. The apparatus of claim 14 in which said substantially airtight seal comprises a fitting, said fitting position along said perimeter of said cavity of said flexible diaphragm and lying over said space between said containers and said flexible diaphragm.

16. The apparatus of claim 11 in which said frame further comprises a partition, said partition lying adjacent and being integral with said casing of said flexible diaphragm.

* * * * *